US011638461B2

(12) United States Patent
Hanat et al.

(10) Patent No.: US 11,638,461 B2
(45) Date of Patent: May 2, 2023

(54) SPORTS SHOE

(71) Applicant: SALOMON S.A.S., Epagny Metz-Tessy (FR)

(72) Inventors: Marylene Hanat, Aix les Bains (FR); Nicolas Horvais, Grésy sur Aix (FR); Anne Deroulede, La Motte Servolex (FR); Lauriane Dugit-Gros, Pringy (FR)

(73) Assignee: SALOMON S.A.S., Epagny Metz-Tessy (FR)

( * ) Notice: Subject to any disclaimer, the term of this patent is extended or adjusted under 35 U.S.C. 154(b) by 275 days.

(21) Appl. No.: 16/844,661

(22) Filed: Apr. 9, 2020

(65) Prior Publication Data

US 2020/0323309 A1 Oct. 15, 2020

(30) Foreign Application Priority Data

Apr. 10, 2019 (FR) ..... 1903837

(51) Int. Cl.

| | |
|---|---|
| ***A43B 13/12*** | (2006.01) |
| ***A43B 13/14*** | (2006.01) |
| ***A43B 13/28*** | (2006.01) |
| ***A43C 7/00*** | (2006.01) |

(52) U.S. Cl.

CPC ..... *A43B 13/122* (2013.01); *A43B 13/14* (2013.01); *A43C 7/00* (2013.01); *A43B 13/28* (2013.01)

(58) Field of Classification Search

CPC ..... A43B 13/122; A43B 13/12; A43B 13/127; A43B 13/14; A43B 13/28; A43B 5/00; A43C 1/00; A43C 7/00; A43C 7/1495

See application file for complete search history.

(56) References Cited

U.S. PATENT DOCUMENTS 4,255,877 A * 3/1981 Bowerman ..... A43B 23/17 36/128
4,947,560 A * 8/1990 Fuerst ..... A43B 5/00 36/114
5,566,475 A 10/1996 Donnadieu (Continued)

FOREIGN PATENT DOCUMENTS

EP 0 651 953 A1 5/1995
EP 2 580 978 A1 4/2013

OTHER PUBLICATIONS

Totallyseals.com, What is 'Shore' hardness?, May 9, 2019, https://www.totallyseals.com/blogs/news/what-is-shore-hardness (Year: 2019).*

*Primary Examiner* — Bao-Thieu L Nguyen
(74) *Attorney, Agent, or Firm* — Greenblum & Bernstein, P.L.C.

(57) ABSTRACT

Sports shoe including an outer sole assembly that includes a damping layer extending over substantially the entire length of the outer sole assembly, as well as an upper fixed to the outer sole assembly. The upper includes an envelope configured to surround a portion of a wearer's foot, as well as a non-extensible flexible panel fixed to the envelope in the area of a portion of the lateral junction between the upper and the outer sole. The sports shoe further includes a reinforcement that is comprised of a rigid plastic material having a hardness greater than 40 shore D, the reinforcement including a lateral wing fixed to a portion of a lateral side of the damping layer and to an outer surface of the flexible panel.

16 Claims, 4 Drawing Sheets

(56) References Cited

U.S. PATENT DOCUMENTS 5,692,319 A 12/1997 Parker
5,836,094 A * 11/1998 Figel ..... A43C 11/1493 36/131
6,772,540 B2 * 8/2004 Delgorgue ..... A43B 5/0411 36/50.1
6,860,035 B2 * 3/2005 Girard ..... A43C 1/00 36/50.1
8,079,159 B1 * 12/2011 Rosa ..... A43B 7/16 36/25 R
8,302,329 B2 * 11/2012 Hurd ..... A43B 23/08 36/88
8,479,415 B2 * 7/2013 Berger ..... A43B 3/24 36/101
8,656,612 B2 * 2/2014 Hurd ..... A43B 23/08 36/88
8,959,799 B2 * 2/2015 Nishiwaki ..... A43C 5/00 36/50.1
9,565,898 B2 * 2/2017 Mahoney ..... A43B 23/0295
9,668,534 B2 * 6/2017 Normand ..... A43B 3/34
9,775,402 B2 * 10/2017 Nonogawa ..... A43B 7/143
9,907,363 B2 * 3/2018 Smith ..... A43C 11/1493
10,258,107 B2 * 4/2019 Surace ..... A43B 7/14
10,834,998 B2 * 11/2020 Workman ..... A43B 23/0265
2009/0320330 A1 * 12/2009 Borel ..... A43B 13/14 36/30 R
2011/0119956 A1 * 5/2011 Borel ..... A43D 13/00 36/44
2011/0239486 A1 10/2011 Berger
2012/0079741 A1 * 4/2012 Kohatsu ..... A43C 1/04 36/50.1
2012/0304495 A1 * 12/2012 Brabson ..... A43B 7/12 36/87
2013/0019505 A1 * 1/2013 Borel ..... A43B 13/223 36/103
2013/0059116 A1 * 3/2013 Peikert ..... A43B 13/04 428/138
2013/0074371 A1 * 3/2013 Borel ..... A43B 7/142 36/102
2013/0086818 A1 4/2013 Donnadieu
2013/0192091 A1 * 8/2013 Kohatsu ..... A43B 23/026 36/103
2014/0026443 A1 * 1/2014 Derrier ..... A43B 13/141 36/107
2014/0250727 A1 * 9/2014 VanDernoot ..... A43B 7/34 36/102
2015/0143720 A1 * 5/2015 Avar ..... A43B 23/16 36/107
2015/0289591 A1 * 10/2015 Jones ..... A43B 3/128 36/88
2015/0289595 A1 * 10/2015 Rushbrook ..... A43B 23/027 36/50.1
2017/0105486 A1 * 4/2017 Klein ..... A43C 1/06
2019/0200700 A1 * 7/2019 Hale ..... A43B 13/04
2019/0328082 A1 * 10/2019 Del Biondi ..... A43B 13/206
2020/0138147 A1 * 5/2020 Fogg ..... A43C 11/08
2020/0205515 A1 * 7/2020 Cross ..... A43C 1/00
2020/0352277 A1 * 11/2020 Rasmussen ..... A43B 13/186
2020/0383421 A1 * 12/2020 Bidal ..... A43B 3/0052
2021/0059351 A1 * 3/2021 Piacentini ..... A43B 13/20
2021/0244126 A1 * 8/2021 Chang ..... A43B 23/088
2021/0259367 A1 * 8/2021 Ekstrom ..... A43B 13/223
2021/0330029 A1 * 10/2021 Case ..... A43B 13/188

* cited by examiner

SPORTS SHOE

CROSS-REFERENCE TO RELATED APPLICATION

This application is based upon French Patent Application No. FR 19 03837, filed Apr. 10, 2019, the disclosure of which is hereby incorporated by reference thereto in its entirety, and the priority of which is claimed under 35 U.S.C. § 119.

BACKGROUND

1. Field of the Invention

The present invention relates to an article of footwear, such as a walking or sports shoe.

2. Background Information

When walking or running, and more particularly on uneven terrain, as may be the case on mountainous terrain, the user looks for support stability while maintaining a certain freedom for greater ease of movement. This stability enables the user to limit trauma and avoid injuries such as sprains or strains. To this end, the wearer's shoes provide good foot support.

Various shoe constructions offer an answer to this expectation. A number of shoes incorporate a rear stiffener mainly covering the heel and not the sides of the foot. In this case, the lateral support is not optimum. Another type of construction involves inserting a reinforcement provided with lateral and/or medial wings between the damping layer of an outer sole assembly and the upper. Foot support is good, but the damping layer located under the reinforcement tends to add instability. Another type of construction includes flexible reinforcement bands surrounding the instep and capable of extending up to the lacing system. The foot is thus properly wrapped and relatively well supported. However, the lateral support is not optimum; the risk of twisting the foot remains. Another construction incorporates a rigid shell extending over mainly the entire length of the sole and comprising lateral and/or medial wings, extending towards the upper. In these constructions, the lateral wings rise slightly on the upper and are not coupled to a flexible reinforcement band associated with the lacing system. The lateral support of the foot is relatively good. However, the rigid shell causes stiffness, especially for the rolling movement of the foot, and thus reduces the ease of foot movement.

A trauma study has shown that about 80% of injuries suffered during hiking occur in the area of the ankle. In the majority of cases, 95% of the injuries observed are external ankle sprains. It is therefore essential to increase the lateral support of the foot to limit this type of injury.

SUMMARY

The invention provides an improved shoe.

The invention particularly provides a shoe construction ensuring very good lateral support of the foot.

The invention also provides a shoe construction allowing for good ease of foot movement and, in particular, good foot rolling movement.

Further, the invention provides a comfortable shoe.

Still further, the invention provides a shoe comprising:

- an outer sole assembly comprising a damping layer extending over substantially the entire length of the outer sole assembly,
- an upper fixed to the outer sole assembly, the upper comprising
  - an envelope intended to surround a portion of the foot of the user, and
  - a non-extensible flexible panel fixed to the envelope in the area of a portion of the lateral junction between the upper and the outer sole.

The sports shoe further comprises a reinforcement comprised of a rigid plastic material, having a hardness greater than 40 shore D, the reinforcement comprising a lateral wing fixed to a portion of a lateral side of the damping layer and to an outer surface of the flexible panel.

This shoe construction provides excellent lateral support for the foot. The lateral support of the foot is ensured by the non-extensible panel adjusted by the tightening system, on the one hand, and by the rigid reinforcement superimposed at the base of the non-extensible panel, on the other hand. Covering a lateral portion of the damping layer of the outer sole assembly reinforces the lateral retention. This construction positions the non-extensible panel and a portion of the reinforcement so as to cover a portion of the lateral quarter of the upper, the support elements, namely the non-extensible panel and the reinforcement, are positioned opposite the lateral side of the foot, substantially in the area of the cuboid bone. This is the location in which it is important to support the foot in order to improve stability. This construction makes it possible to position the stiffening elements in the locations that are strictly necessary without negative impact on the flexibility of the shoe and, in particular, without penalizing the foot rolling movement.

According to advantageous but non-essential aspects of the invention, a shoe of this type can incorporate one or more of the following characteristics, taken in any technically acceptable combination:

- the flexible panel and the support lateral wing are arranged so that a portion of the flexible panel and/or of the lateral wing is positioned opposite the Lisfranc joint or tarsometatarsal joint of the foot, when the foot is in the shoe;
- the flexible panel comprises an upper end carrying a member for guiding a portion of a lace of a shoe tightening system;
- the reinforcement comprises a transverse branch covering a portion of a lower surface of the damping layer, the transverse branch extending transversely over substantially the entire width of the outer sole assembly;
- the transverse branch is positioned longitudinally only opposite a transition zone of the lower surface of the damping layer located below the arch of the foot;
- in the area of the lateral junction between the upper and the outer sole, the portion of the lateral wing opposite the flexible panel extends over a portion of the lateral junction between a first limit positioned at a distance of one eighth of the length of the outer sole assembly starting from the rear end and a second limit positioned at a distance of half the length of the outer sole assembly;
- the flexible panel is oriented along a main axis inclined forward by an angle between 25° and 75° in relation to a horizontal plane, and the portion of the lateral wing opposite the flexible panel is oriented along a main axis inclined forward by an angle between 25° and 75° in relation to a horizontal plane;
- a portion of the lateral wing is glued to the flexible panel;

the reinforcement comprises a medial wing fixed to at least a portion of a lateral side of the damping layer;

the lateral wing covers at least a quarter of the height of the flexible panel;

the lateral wing does not extend above half the height of the upper;

the lateral wing is dimensioned so that the rigidity of the wing decreases the farther it extends away from the outer sole assembly;

the reinforcement is comprised of one of the following materials: polyamide (PA), thermoplastic polyurethane (TPU), polyester (PE), or a composite material;

the flexible panel is fixed to the envelope over at least the lower quarter of the height of the flexible panel; and the flexible panel is detached from the envelope over at least the upper half of the height of the panel.

BRIEF DESCRIPTION OF DRAWINGS

Other characteristics and advantages of the invention will be better understood from the description that follows, with reference to the annexed drawings illustrating, by way of non-limiting embodiments, how the invention can be carried out, and in which.

DETAILED DESCRIPTION

The following of the description makes use of terms such as "vertical", "upper", "lower", "top", "bottom", "transverse", "lateral", "medial", "right", "left", "horizontal", "anterior", "posterior", "front", "behind", "front", "rear". These terms should be considered as relative terms in relation to the normal position occupied by the shoe occupies on the foot of a user, and to the normal direction of forward displacement of a user. We will consider the configuration for which the sole is laid flat on a horizontal ground.

The terms "lateral" and "medial" are conventionally understood to mean facing outward and inward, respectively. Thus, the medial side of a foot or of a shoe is turned towards the medial side of the other foot or other shoe of the user.

The term "longitudinal" refers to a heel-to-toe direction corresponding to the X axis, whereas the term "transverse" refers to a lateral-to-medial direction corresponding to the Y axis and, therefore, substantially perpendicular to the longitudinal direction. The vertical or bottom-to-top direction corresponds to the Z axis.

In the description, a "shoe" is defined by a "sole assembly" and an "upper". The "sole assembly" is the lower portion of the shoe between the foot and the ground. This is the bottom of the shoe. The "upper" is the upper portion of the shoe enveloping the foot and possibly a portion of the ankle. This is the top of the shoe. The upper is affixed to the peripheral edge of the sole assembly. Notable is the fact that certain elements of the shoe can form both a portion of the sole assembly and a portion of the upper.

FIGS. 1-7 illustrate the construction of a sports shoe 1 according to a first embodiment of the invention. The sports shoe 1 for the right foot shown is a running shoe but could be a completely different type of sports shoe. The shoe 1 is shown in perspective, top view in FIG. 1. It comprises an upper 2 overlaying a sole assembly 3.

Figure 4:
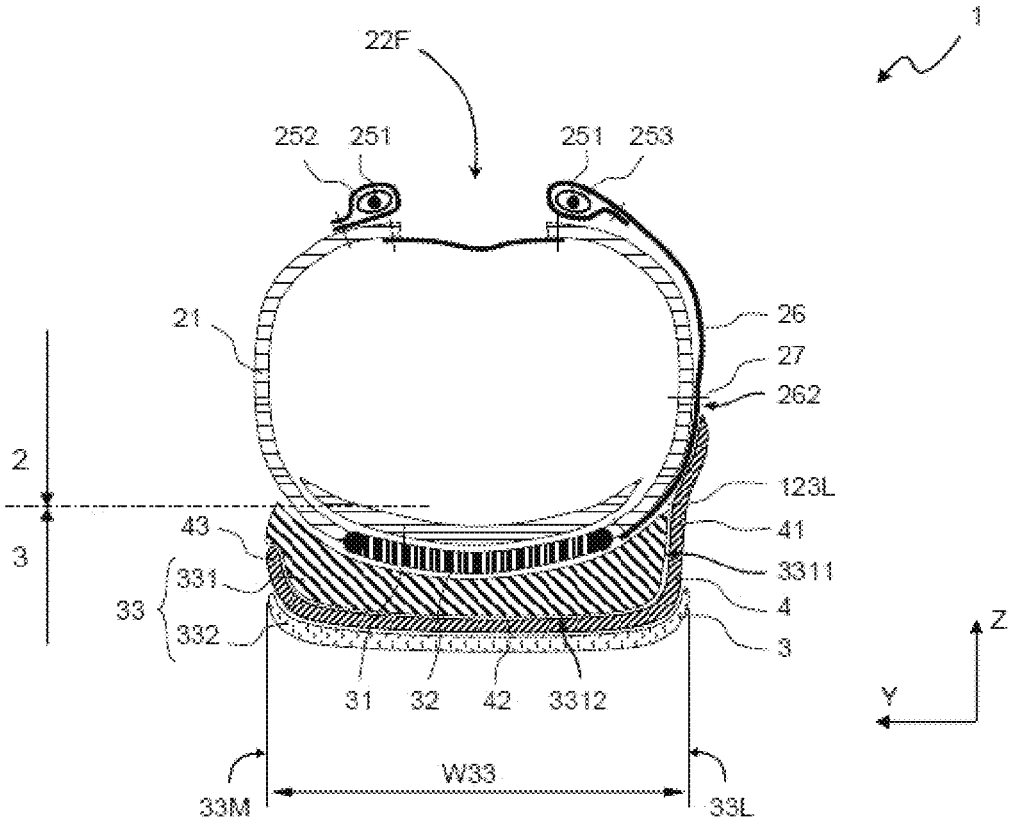
FIG. 4 is a schematic view of the cross section along the line IV-IV of FIG. 1.
Figure 5:
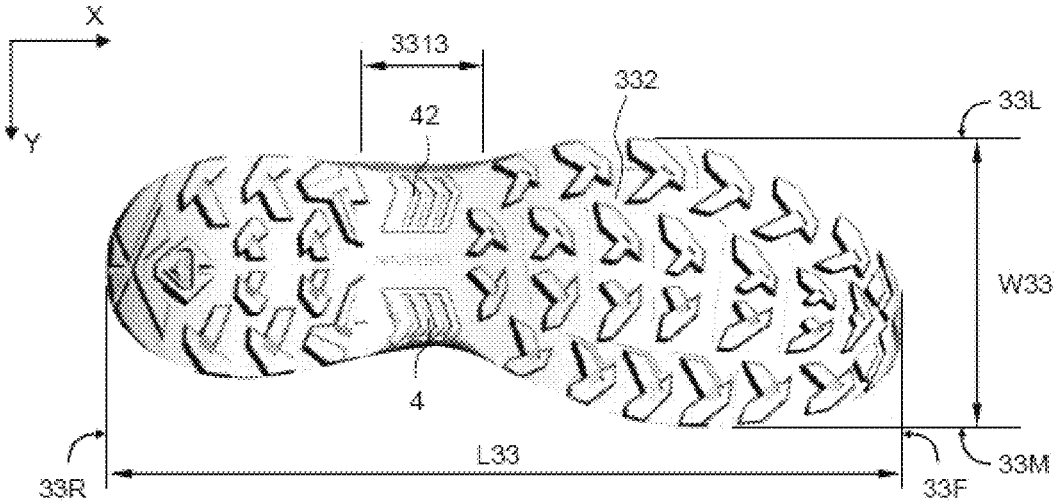
FIG. 5 is a top view of the shoe of FIG. 1.
Figure 6:
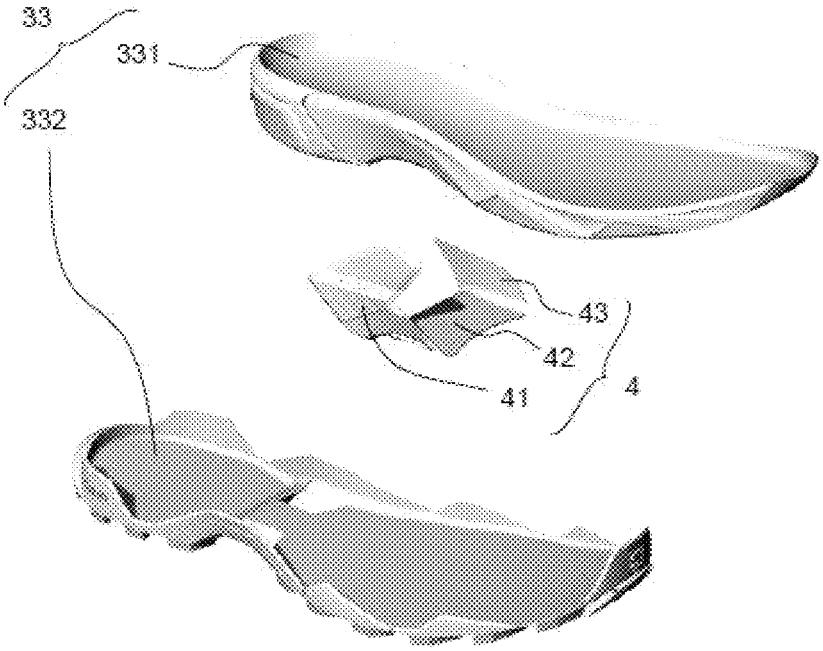
FIG. 6 is an exploded view of an outer sole assembly of the shoe of FIG. 1.

In this example, the sole assembly 3 comprises superposed layers between the ground and the bottom of the foot, as illustrated in FIG. 4. Starting from the foot, the first layer is an insole 31. It is generally removably mounted within the shoe. The next layer located below the insole 31 is a lasting board 32. This second layer 32 is generally fixed to the lower peripheral edges of the upper 2. Finally, an outer sole assembly 33 is located beneath the lasting board 32. The outer sole assembly 33 is generally fixed to the lasting board 32 in any conventionally known fashion, for example by an adhesive or glue. The outer sole assembly 33 is intended to come into contact with the ground.

The outer sole assembly 33 extends lengthwise from a rear end 33R to a front end 33F, thereby defining a length L33 of the sole assembly, widthwise between a lateral side 33L and a medial side 33M, thereby defining a width W33 of the sole assembly.

Here, the outer sole assembly 33 comprises a damping layer 331 and a wear layer 332, and a portion of a reinforcement 4 which will be described later.

The damping layer 331 is made of a material comprised of cellular foam, for example ethylene-vinyl acetate (EVA) or thermoplastic polyurethane (TPU). Other materials are also within the scope of the invention. The layer 331 extends over substantially the entire length L33 of the outer sole assembly, that is to say, at least 90% of the total length of the outer sole assembly.

The wear layer 332 is fixed to the damping layer 331 so as to cover a large portion of the lower surface of the damping layer. The wear layer 332 is thus interposed between the damping layer 331 and the ground. As seen in FIGS. 1-3 and 7, it can extend upward on the front portion 33F of the sole assembly so as to demarcate the front end 33F of the sole assembly. The wear layer 332 is intended to be systematically in contact with the ground. It thus ensures that the shoe grips the ground. Generally, the wear layer 332 is made of rubber or thermoplastic polyurethane (TPU).

In this example, the upper 2 comprises an envelope 21 extending lengthwise from a rear end 21R to a front end 21F, widthwise between a lateral side 21L and a medial side 21M, and heightwise from the sole assembly 3 to an upper end 21U, the upper end 21U having a foot insertion opening 22, the foot insertion opening 22 having a rear subdivision 22R and a front subdivision 22F. Conventionally, the envelope 21 is configured to surround a large portion of the foot. It includes a vamp covering the front of the foot and lateral and medial quarters covering the rear of the foot, and in particular the heel. The envelope is made of a flexible material so as to be capable of conforming to the shape of the foot. A number of materials can be envisioned. It may be a canvas, a fabric, a knitted fabric, a film, etc. The envelope 21 can be locally reinforced to ensure retention of the upper and/or to protect the foot. For example, a "hard toe-piece" 23 can cover the upper portion of the front end 21F of the envelope 21. The front subdivision 22F is demarcated by sides of the envelope, in the area of the vamp. Each of these lateral and medial sides carries a series of keepers 252 intended to receive a lace 251 of a tightening system 25. The tightening system includes the keepers 252, the lace 251 passing through the keepers 252, and a blocker, not shown, for adjusting the length of the lace in engagement with the keepers, in the area of the front subdivision 22F. The tightening system enables the sides of the front subdivision 22F to be brought closer together, ensuring that the instep is gripped by the vamp. This tightening substantially contributes to providing good support for the foot.

Figure 1:
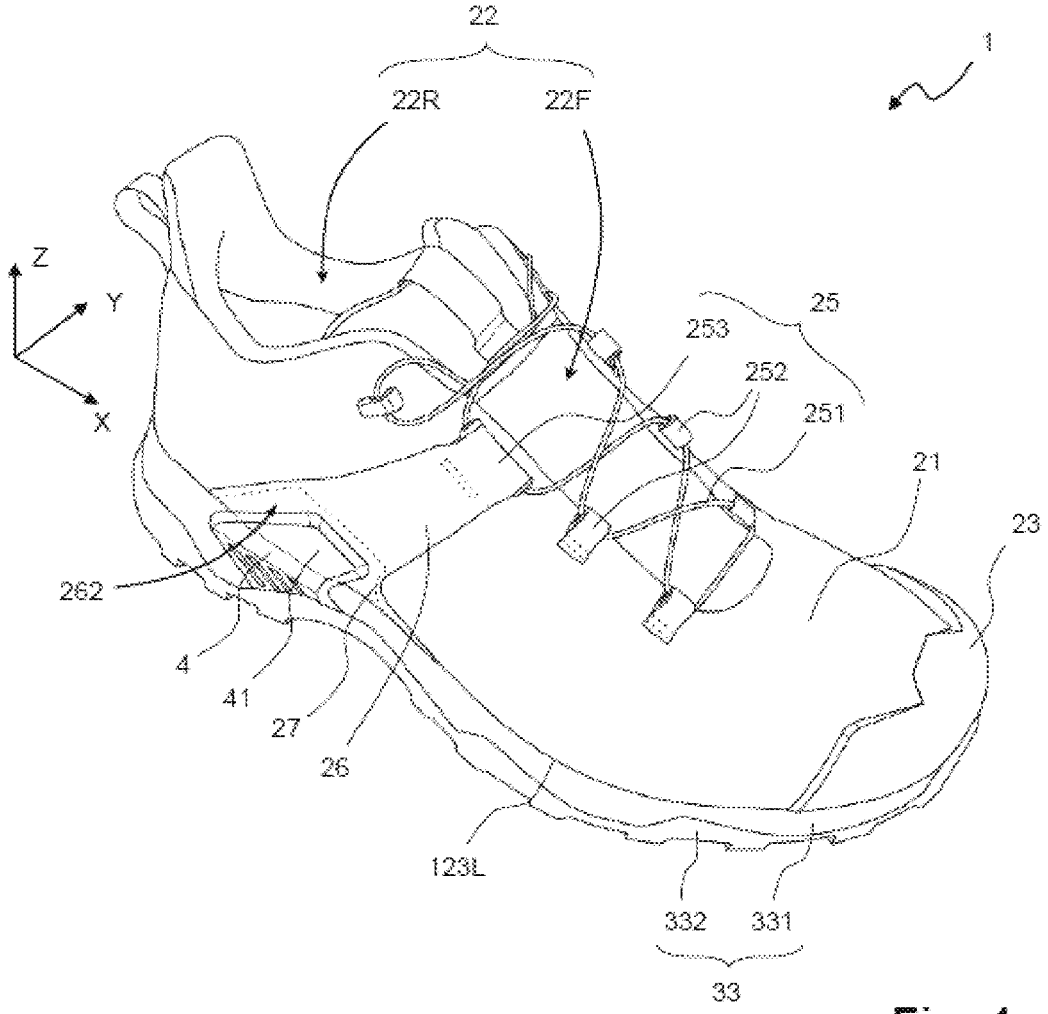
FIG. 1 is a front perspective top view of a shoe for a right foot according to the invention.
Figure 2:
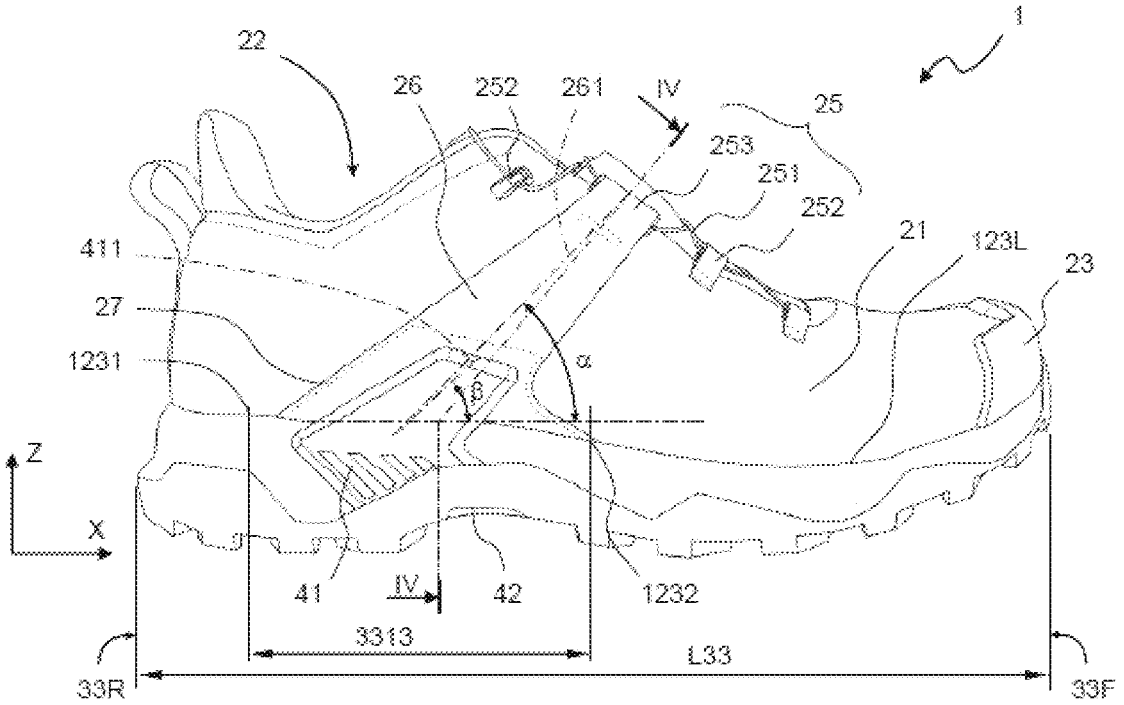
FIG. 2 is a side view of the shoe of FIG. 1 from the lateral side.
Figure 3:
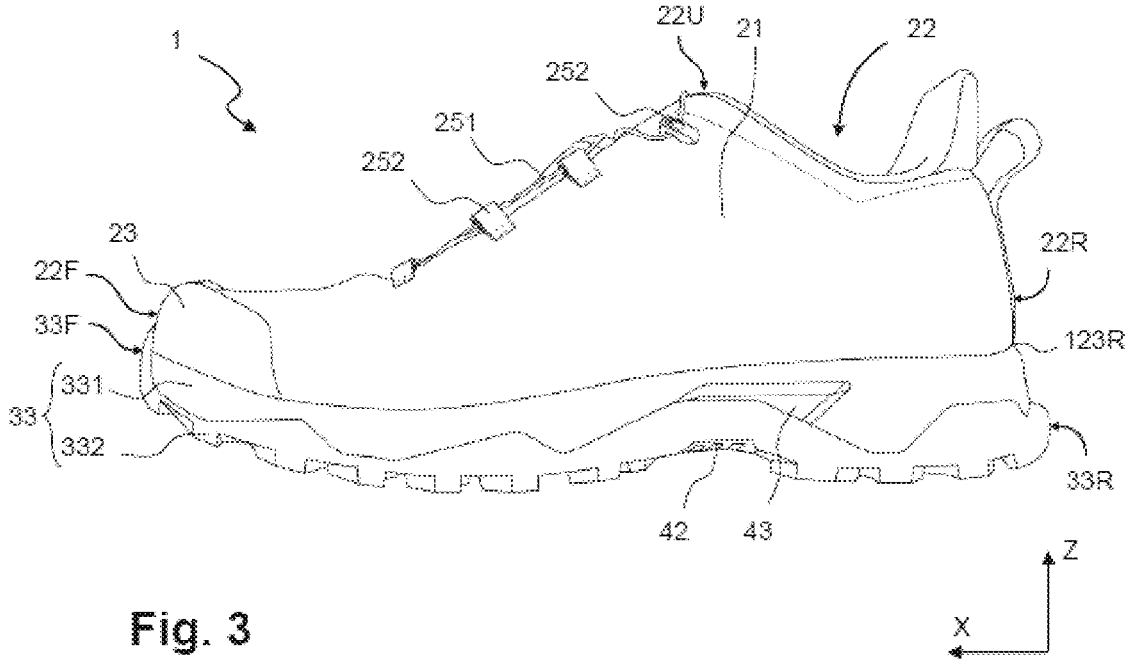
FIG. 3 is a side view of the shoe of FIG. 1 from the medial side.

According to the invention, the upper 2 also comprises a non-extensible flexible panel 26 covering a lateral portion of the envelope 21. In the context of the invention, a non-extensible panel is a panel made of a material that deforms only slightly or does not deform when stretched. The non-extensible panel can be a canvas, a fabric, or a film. The non-extensibility property can be obtained by means of a coating affixed to a material, for example by coating, projection, or printing. The non-extensible flexible panel 26, referred to in various instances as "flexible panel" for convenience, extends over the entire height of the upper, from the sole assembly 3 to the lateral side of the front subdivision 22F, The lower end of the flexible panel 26 is thus fixed to the envelope 21, in the area of a portion of the lateral junction 123L between the upper 2 and the outer sole assembly 33. The upper end of the flexible panel 26 carries a member 253 for guiding a portion of the lace 251 of the tightening system 25 of the shoe. This guide member is positioned instead of a keeper 252 from the series of keepers positioned on the lateral side of the front subdivision 22F. In this example, the guide member 253 is a keeper. Other types of guide members, such as a hook, for example, are also within the scope of the invention. By acting on the tightening system, the user thus presses the flexible panel 26 flat against the envelope 21. The flexible panel 26 then makes it possible to reinforce the lateral support of the foot. The flexible panel 26 is fixed to the envelope 21 by any suitable means, such as gluing and/or welding and/or stitching the lower portion of the flexible panel 26 is stitched to the envelope 21. FIGS. 1, 2 and 4 illustrate the assembly stitches 27.

In this example, in the area of the lateral junction 123L between the upper 2 and the outer sole assembly 33, the flexible panel 26 extends over a portion of the junction 123L between a first limit 1231 positioned at a distance of one eighth of the length L33 of the outer sole assembly starting from the rear end 33R and a second limit 1232 positioned at a distance of half the length of the outer sole assembly. This positioning ensures that the flexible panel 26 is located opposite a specific zone of the foot for which support is necessary to improve the stability of the foot.

In this example, the flexible panel 26 forms a band having edges converging upwards. The band is oriented along a main axis 261, inclined forward by an angle $\alpha$ between 25° and 75° in relation to a horizontal plane XY. This inclination allows positioning the reinforcement by the flexible panel only locally. This prevents stiffening of the envelope in zones in which flexibility is desired to facilitate the movement of the foot, in particular the rolling movement of the shoe, and thereby improves the ease of movement.

In this example, the flexible panel 26 is fixed to the envelope 21 over at least the lower quarter of the height of the flexible panel. Otherwise formulated, the flexible panel 26 is fixed to the envelope over at least the lower quarter of the panel, along the main axis 261 of the flexible panel 26. By being fixed to the envelope 21 in its lower portion, the flexible panel 26 is completely affixed to the envelope 21. The reinforcing function is fully ensured in this important zone for stability. There is no risk of an external element being inserted between the flexible panel 26 and the envelope 21. This avoids any discomfort or hard spot (local pressure) during tightening.

In this example, the flexible panel 26 is detached from the envelope 21 over at least the upper half of the height of the flexible panel. Otherwise formulated, the flexible panel 26 is detached from the envelope 21 over at least the upper half of the panel along the main axis 261 of the flexible panel 26. The fact that the flexible panel is not affixed to the envelope in its upper portion prevents stiffening of the envelope 21 in the area of the vamp. This makes it easier to insert the foot in the shoe.

According to the invention, the non-extensible flexible panel 26 is coupled to a reinforcement 4 comprised of a rigid plastic material having a hardness greater than 40 shore D in one embodiment, or greater than 50 shore D in another embodiment. Such a material can be polyamide (PA), thermoplastic polyurethane (TPU), polyester (PE), or a composite material, for example based on carbon fibers. Thus, the lateral support of the foot is substantially improved by the coupling of the reinforcement 4 to the flexible panel 26. For the support to be effective, a lateral portion 41 of the reinforcement 4, referred to as a "lateral wing" below, is fixed to an outer surface 262 of the flexible panel 26 by any suitable means, such as gluing, welding, or stitching. Advantageously, the lateral wing 41 of the reinforcement 4 covers at least a quarter of the height of the flexible panel 26. According to one embodiment, the lateral wing 41 of the reinforcement 4 covers the flexible panel 26 over at least 1.5 centimeters, heightwise with respect to the lateral junction 123L between the upper 2 and the outer sole assembly 33. According to one exemplary detail, the lateral wing 41 of the reinforcement 4 does not extend above half the height of the upper 2 in order not to stiffen the envelope 21 in the area of the vamp. This makes it easier to insert the foot in the shoe. The lateral wing 41 can be dimensioned so that the rigidity of the wing decreases the farther away it extends from the outer sole assembly 33. For example, the thickness of the wing can decrease as a function of the height of the wing; the higher the wing, the thinner it becomes. This progressive variation in stiffness makes it possible to provide flexibility in the upper portion of the wing, a zone in which it may be necessary to facilitate the deformation to assist the insertion of the foot into the shoe.

To achieve good lateral support, the lateral wing 41 of the reinforcement 4 is also fixed to a portion of a lateral side 3311 of the damping layer 331. This makes it possible to contain the damping layer, in particular by preventing it from being offset laterally. It is thus advantageous for the lateral wing 41 of the reinforcement 4 to cover a portion of the outer sole assembly 33.

To further increase lateral support, the reinforcement 4 comprises anchoring structure configured to keep the reinforcement in position and to prevent the lateral wing 41 from collapsing or bending laterally.

According to the illustrated embodiment, the reinforcement 4 comprises a transverse branch 42 covering a portion of a lower surface 3312 of the damping layer 331. The transverse branch 42 extends transversely, over substantially the entire width W33 of the outer sole assembly 33. Thus, the transverse branch 42 and the lateral wing 41 are oriented substantially at 90° in relation to one another. This configuration ensures very good anchoring of the reinforcement 4 which makes it possible to limit the bending of the lateral wing 41.

Advantageously, the transverse branch 42 is positioned longitudinally only opposite a transition zone 3313 of the lower surface 3312 of the damping layer 331 located below the arch of the foot. This transition zone 3313 is located between two zones of contact with the ground. These contact zones are provided on the wear layer 332 and are provided with studs. Due to this arrangement, there is no rigid portion of the reinforcement 4 opposite the studs. This allows for better grip and damping because the studs can more easily deform vertically. In addition, the location of the transverse branch in the transition zone prevents stiffening of the outer sole assembly in the metatarsal zone. The sole can more easily bend about a transverse axis Y, which improves the behavior of the shoe and, in particular, the rolling movement of the foot.

In this example, the reinforcement 4 also comprises a medial wing 43 rising on the outer sole assembly 33 so as to cover only a portion of a medial side 3312 of the damping layer 331. The medial wing 43 does not cover any medial portion of the upper 2. According to an alternative embodiment, the medial wing 43 extends further upwards to cover a medial portion of the upper 2. The medial wing 43 makes it possible to strengthen the anchoring of the reinforcement 4 and, more particularly, to retain the transverse position of the reinforcement.

Thus, the reinforcement is constructed so as to form a U-shape.

Alternatively, other shapes are also within the scope of the invention for the reinforcement. For example, the anchor can be a hoop, fixed to the outer sole assembly and extending along the rear junction 123R between the upper 2 and the outer sole assembly 33, in the area of the heel.

In this example, the portion of the lateral wing 41 opposite the flexible panel 26 forms a plate having edges converging upwards. The plate is oriented along a main axis 411, inclined forward by an angle β between 25° and 75° in relation to a horizontal plane XY. This inclination makes it possible to position the strengthening by the reinforcement only locally. This prevents stiffening of the envelope in zones in which flexibility is desired to facilitate the movement of the foot and, in particular, the rolling movement of the shoe, and thereby improves the ease of movement. The main axis 411 of this covering portion can be merged with or substantially parallel to the main axis of the flexible panel 26.

In this example, in the area of the lateral junction 123L between the upper 2 and the outer sole assembly 33, the portion of the lateral wing 41 opposite the flexible panel 26 extends over a portion of the junction 123L between a first limit 1231 positioned at a distance of one eighth of the length L33 of the outer sole assembly starting from the rear end 33R and a second limit 1232 positioned at a distance of half the length of the outer sole assembly. This positioning makes it possible to ensure that the lateral wing 41 of the reinforcement 4 is located opposite a specific zone of the foot for which support is necessary to improve the stability of the foot.

As has been shown, stability is provided by the overlap between the non-extensible flexible panel 26 and the lateral wing 41 of the support 4. The lateral wing 41 is fixed to the flexible panel 26.

Figure 7:
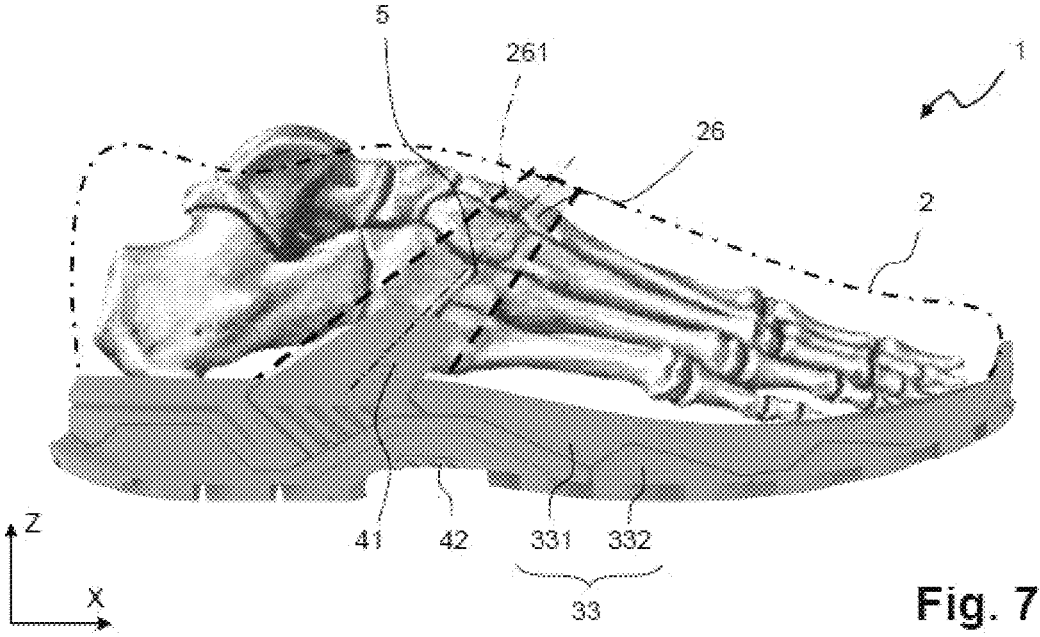
FIG. 7 is a schematic side view of the shoe of FIG. 1 from the lateral side, showing the bony portion of a foot that would be inserted into the shoe.

To improve lateral retention, it is important to have lateral support opposite the Lisfranc joint or tarsometatarsal joint of the foot. The Lisfranc joint 5, whose interlining extends transversely from one side to the other of the foot, joins the three cuneiform bones and the cuboid bone with the five metatarsals. During a stride, the foot pivots about this joint which is thereby substantially biased. In the absence of support, there is a greater risk of twisting the foot. Thus, according to an advantageous embodiment, the flexible panel 26 and the lateral wing 41 of the support 4 are arranged so that a portion of the flexible panel 26 and/or of the lateral wing 41 is positioned opposite the Lisfranc joint 5 or tarsometatarsal joint of the foot, when the foot is in the shoe. This positioning is illustrated in FIG. 7. This construction proves particularly effective in preventing the risk of external ankle sprains.

According to another embodiment, the non-extensible flexible panel 23 does not carry a member 253 for guiding a portion of a lace 251 of a tightening system 25 of the shoe. The upper end of the flexible panel is then directly fixed to the upper, for example by stitching. In such a case, the lateral side of the front subdivision 22F comprises a series of keepers 252 arranged symmetrically with the series of keepers 252 of the medial side of the front subdivision 22F. The tightening system 25 does not include a loop associated with the extensible flexible panel 23.

In the example described, the lower portion of the reinforcement 4 is interposed between the damping layer 331 and a portion of the wear layer 332 of the outer sole assembly 33. According to another embodiment, the lower portion of the reinforcement 4 also covers a portion of the wear layer 332. For example, the reinforcement can completely cover a portion of the assembly of the damping 331 and wear 332 layers of the outer sole assembly 33. This construction can facilitate the manufacturing process of the outer sole assembly 33, the reinforcement being capable of being attached after the assembly of the damping 331 and wear 332 layers.

According to another embodiment, the flexible panel 26 is extended to also cover a portion of the bottom of the foot. In this case, the flexible panel 26 is inserted between the lasting board 32 and the outer sole assembly 33. Alternatively, the flexible panel 26 is further extended to also cover a medial portion of the envelope 21. This medial portion of the flexible panel 26 rise to the lateral side of the front subdivision 22F and can also carry a member for guiding a portion of a lace of a tightening system 25 of the shoe. Thus, the flexible panel can form a U-shape. The medial portion of the flexible panel 26 can be fixed to the envelope in the same way as the lateral portion of the flexible panel, as has been described above. According to another embodiment, the shoe can comprise two distinct flexible panels, each panel being fixed to the lateral portion and the medial portion, respectively, of the envelope 21. According to an alternative embodiment, the medial portion of the flexible panel 26 can be covered by a medial wing of a reinforcement 4. Thus, the flexible panel and/or the reinforcement are constructed symmetrically with respect to a central vertical plane XZ, in the sense that the flexible panel and/or the reinforcement rise on either side of the envelope 21 of the upper 2. The flexible panel and/or the reinforcement are not necessarily dimensioned identically in the area of their medial portion and their lateral portion.

The invention is not limited to the embodiments previously described. It is also possible to combine these embodiments. The invention extends to all the embodiments covered by the appended claims.

Further, at least because the invention is disclosed herein in a manner that enables one to make and use it by virtue of the disclosure of particular exemplary embodiments, such as for simplicity or efficiency, for example, the invention can be practiced in the absence of any additional element or additional structure that is not specifically disclosed herein.

The invention claimed is:

1. A sports shoe comprising:

an outer sole assembly comprising a damping layer having a length extending along a length of the outer sole assembly between an area of a front of the outer sole assembly and an area of a rear of the outer sole assembly;

an upper fixed to the outer sole assembly, the upper comprising:

an envelope intended to surround a portion of the foot of the user, and a non-extensible flexible panel fixed to the envelope in an area of a portion of a lateral junction between the upper and the outer sole assembly;

the sports shoe further comprising a reinforcement, the reinforcement being distinctive part in relation to the damping layer, the reinforcement being comprised of a rigid plastic material having a hardness greater than 40 shore D, the reinforcement comprising a lateral wing fixed to a portion of a lateral side of the damping layer and to an outer surface of the non-extensible flexible panel.

2. Sports shoe according to claim 1, wherein:

the non-extensible flexible panel and the lateral wing of the reinforcement are configured so that a portion of either one or both of the non-extensible flexible panel and the lateral wing is positioned opposite a Lisfranc joint or tarsometatarsal pint of a foot when the loot is in the shoe.

3. Sports shoe according to claim 1, wherein:

the non-extensible flexible panel comprises an upper end carrying a member for guiding a portion of a lace of a tightening system of the shoe.

4. Sports shoe according to claim 1, wherein:

the reinforcement comprises a transverse branch covering a portion of a lower surface of the damping layer, the transverse branch extending transversely over substantially an entire width of the outer sole assembly.

5. Sports shoe according to claim 4, Wherein:

the transverse branch is positioned longitudinally only opposite a transition zone of the lower surface of the damping layer configured to be located below an arch of the foot.

6. Sports shoe according to claim 1, wherein:

in an area of the lateral junction between the upper and the outer sole, the portion of the lateral wing opposite the non-extensible flexible panel extends over a portion of the lateral junction between a first limit positioned at a distance of one eighth of the length of the outer sole assembly starting from the rear end and a second limit positioned at a distance of half the length of the outer sole assembly.

7. Sports shoe according to claim 1, wherein:

the non-extensible flexible panel is oriented along a main axis inclined forward by an angle between 25° and 75° in relation to a horizontal plane; and the portion of the lateral wing opposite the non-extensible flexible panel is oriented along a main axis inclined forward by an angle between 25° and 75° in relation to a horizontal plane.

8. Sports shoe according to claim 1, wherein:

a portion of the lateral wing is glued to the non-extensible flexible panel.

9. Sports shoe according to claim 1, wherein:

the reinforcement comprises a medial wing fixed to at least a portion of a lateral side of the damping layer.

10. Sports shoe according to claim 1, wherein:

the lateral wing covers at least a quarter of a height of the non-extensible flexible panel.

11. Sports shoe according to claim 1, wherein;

the lateral wing does not rise above half a height of the upper.

12. Sports shoe according to claim 1, wherein:

the lateral wing is dimensionally configured so that the lateral wing has a rigidity decreasing as the lateral wing extends farther from the outer sole assembly.

13. Sports shoe according to claim 1, wherein:

the reinforcement is comprised one of the following materials: polyamide (PA), thermoplastic polyurethane (TPU), polyester (PE), or a composite material.

14. Sports shoe according to claim 1, wherein:

the non-extensible flexible panel is fixed to the envelope over at least a lower quarter of a height of the non-extensible flexible panel.

15. Sports shoe according to claim 1, wherein:

the non-extensible flexible panel is detached from the envelope over at least an upper half of a height of the panel.

16. A sports shoe according to claim 1, wherein the damping layer extends over at least 90% of a total length of the outer sole assembly.

* * * * *